United States Patent [19]

DePatie et al.

[11] Patent Number: 4,921,446

[45] Date of Patent: May 1, 1990

[54] TELEPHONE JACK APPARATUS

[75] Inventors: Lauralee DePatie, Surrey; Edward Gaglardi, Mission, both of Canada

[73] Assignee: British Columbia Telephone Company, Burnaby, Canada

[21] Appl. No.: 318,918

[22] Filed: Mar. 6, 1989

[51] Int. Cl.[5] ..... H01R 13/60

[52] U.S. Cl. ..... 439/536; 439/676

[58] Field of Search ..... 439/536, 569, 676, 544, 439/557

[56] References Cited

U.S. PATENT DOCUMENTS

| | | | |
|---|---|---|---|
| 2,531,350 | 11/1950 | Chrastina | 439/535 X |
| 4,039,235 | 8/1977 | Thibeault | 439/97 |
| 4,451,106 | 5/1984 | Wiseheart et al. | 439/557 X |
| 4,647,725 | 3/1987 | Dellinger et al. | 439/544 X |
| 4,655,529 | 4/1987 | Yokoyama | 439/544 X |

*Primary Examiner*—Eugene F. Desmond

*Attorney, Agent, or Firm*—Farris, Vaughan, Wills & Murphy

[57] ABSTRACT

A telephone jack apparatus which includes a jack body having a plug opening in a front face thereof, terminals in a rear face of the jack body electrically conductively connected to corresponding spring contacts in the plug opening and adapted to receive and conductive association associated respective wires of a telephone cable. a plate affixed to the jack body provides a means for affixing the body to a suitable wall support or receptacle. The entire structure can be installed in a unfinished wall and then after the wall has been completed, a cover plate simply affixed over the socket to complete the installation.

4 Claims, 5 Drawing Sheets

TELEPHONE JACK APPARATUS

BACKGROUND

The present invention relates to a telephone jack apparatus designed for installation on a wall of a building.

In pre-wiring newly constructed buildings, it is usual for a telephone installer to first install a telephone cable throughout the area to each desired outlet before wall board or other equivalent material is applied to the walls. After application of the wall board, the installer must then make a second trip in order to connect the wires of the cable to a jack. A jack is then snapped onto a cover plate which is screwed to a previously installed box or receptacle. Each trip of the telephone installer involves a separate and relatively large service charge. Consequently, the need for two separate trips of a professional installer results in a relatively high installation cost.

U.S. Pat. No. 4,343,527 issued Aug. 10, 1982 to Harrington et al discloses a telephone jack assembly in which wires of the cable are attached to corresponding terminal posts in a box that has been affixed to the wall framing. The jack itself is mounted on a jack plate that screws to the box. Wires from the jack which fit onto the terminal posts to which the cable wires have been attached are affixed after wall board is installed. A cover plate fits over the jack and is screwed to the jack plate. Thus, in Harrington, the second installation step after wall board installation, still requires wiring of the jack to the terminal posts, mounting of the jack to the jack plate and mounting of the jack plate to the box. Following mounting of the jack plate to the box, the cover plate is installed. It would be desirable to eliminate several of the procedures involved in the second installation step as it is one which is designed to be carried out by an untrained person.

Accordingly, it is an object of the present invention to provide an improved apparatus for installation of telephone jacks. In particular, it is an object of the present invention to provide a telephone jack apparatus in which only a simple completion step is required after wall board or the like is applied.

SUMMARY OF THE INVENTION

According to the invention there is provided a telephone jack apparatus which includes a jack body having a plug socket with a plurality of spring contacts therein with the socket opening to a front face. Electrical terminals on a rear face of the jack body each are conductively connected to a corresponding spring contact in the plug socket. A mounting plate is affixed to the body and is attachable to a wall mounted support. The front face is dimensioned to fit through an opening in a cover plate. Means are provided for attaching the cover plate to the mounting plate. Wires from a telephone cable are attachable to the rear face terminals prior to installation of the wall board.

By pre-wiring the jack and installing it onto the wall, prior to application of wall board or the like, the only step required to be taken after the application of the wall board is to install a cover plate. The latter task can easily be relegated to untrained personnel. By utilizing mounting posts for mounting the electrical terminals as well as for connecting thereto associated wires from a telephone cable, a firm, secure connection of the wires of the cable to the telephone jack can be made prior to installation of the wall board.

By providing a rectangular protruding face on the jack body, dimensioned to fit through the opening in a standard switch cover plate, even if the cover plate left by an installer of the pre-wired jack is lost, an untrained person can easily obtain a standard cover plate to apply over the protruding face of the jack body.

BRIEF DESCRIPTION OF THE DRAWINGS

The novel features believed characteristic of the invention are set forth in the appended claims. The invention itself, however, as well as other features and advantages thereof, will be best understood by reference to the detailed description which follows, read in conjunction with the accompanying drawings, wherein:

DETAILED DESCRIPTION WITH REFERENCE TO THE DRAWINGS

Figure 1:
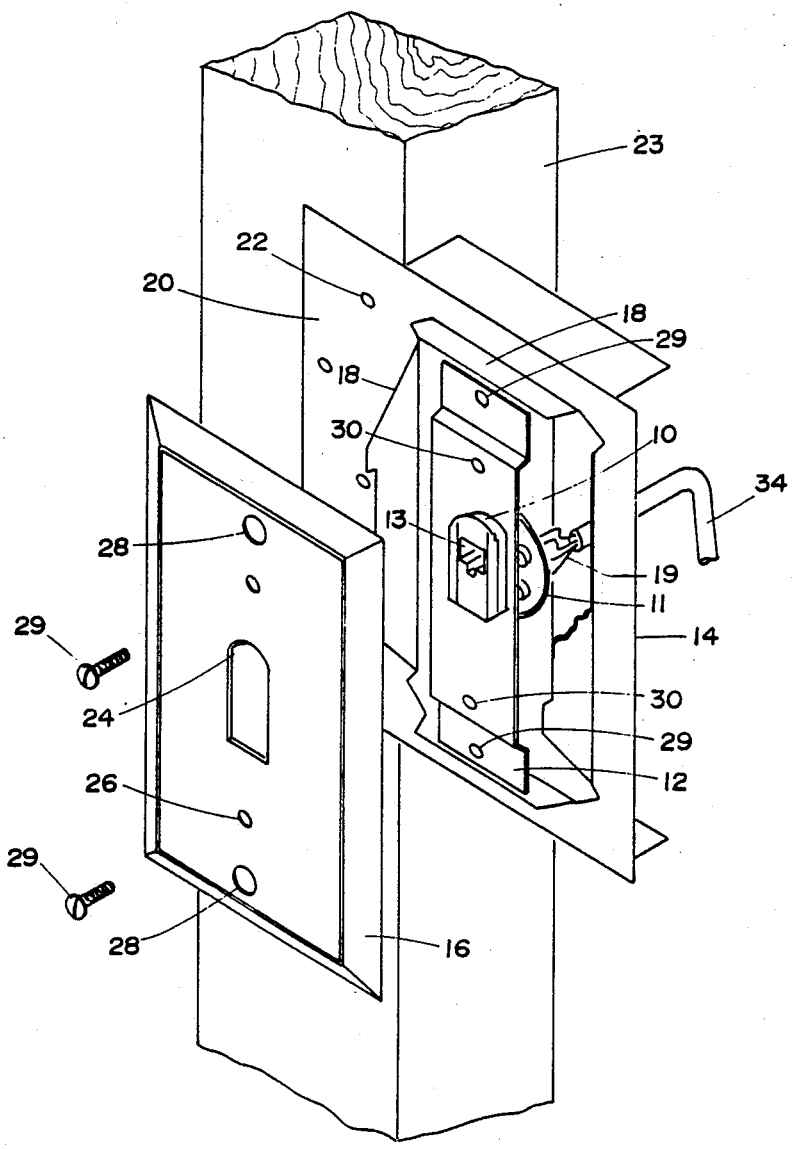
FIG. 1 is a perspective view of a telephone jack assembly in accordance with the present invention wherein the wall mount support is a conventional mud-ring.
Figure 2:
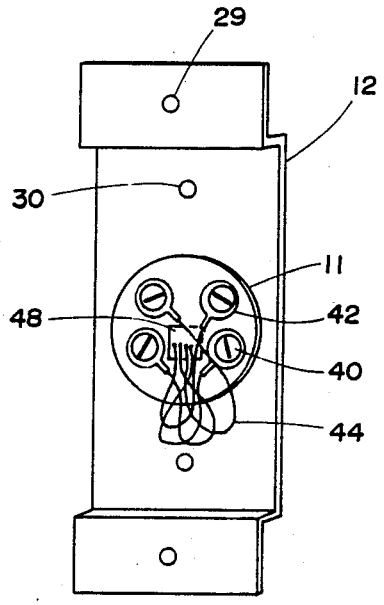
FIG. 2 is a rear elevation view of the mounting plate and jack body of FIG. 1 showing the terminal posts of the jack.

Referring to FIG. 1 there is shown a jack body 10 having a socket 13 opening on a front surface thereof, a mounting plate 12 to which the jack body 10 is secured and which itself is affixed to a mud-ring 14 by means of screws 29 passing through screw holes 26 in plate 12. Mud stops 18 define the boundaries of wall board or other wall covering (not shown) which is to surround the jack assembly. A pair of threaded screw holes 30 are designed to accommodate screws 29 used to attach a cover plate 16 over the assembly after installation of the wall board (not shown). A side flange 20 having holes 22 is used to attach the mud-ring 14 to a wall stud 23 or the like. Cover plate 16 may include a pair of spaced apart holes 28 to accommodate standard telephone mounting studs. Telephone cable 34 is pre-wired with wires 19 thereof, attaching to terminal posts 42 (see FIG. 3) on the back 11 of jack body 10. The latter can be more clearly seen in FIG. 2. In this case jack wires 44 connecting to spring terminals (not seen) through the rear socket opening 48 are connected by means of screws 40 to the terminal posts 42 on the back 11 of the jack body 10.

In practice the telephone cable and mud-rings or equivalent receptacles are first installed by a professional installer. The cable wires 19 are pre-wired coupled to the terminal posts 42 on back 11 of the jack body 10 by means of screws 40. Following application of wall board a non professional can simply install the cover plate 16.

Figure 3:
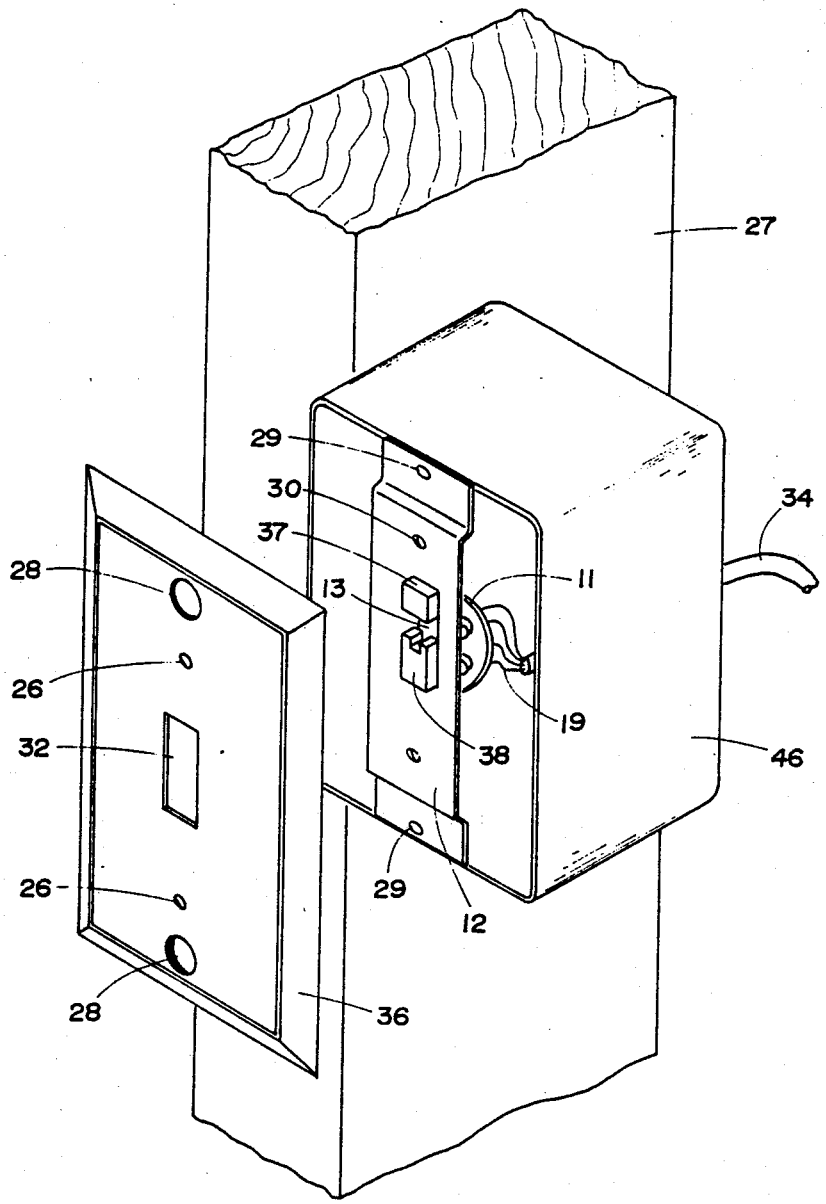
FIG. 3 is a perspective view of an alternative embodiment and the invention in which the jack face around the socket is dimensioned to fit through a standard switch plate and is affixed to a standard box receptacle.

An alternative geometry for implementing the invention is disclosed in FIG. 3 in which a standard switch cover plate 36 having a rectangular opening 32 of a kind in common use for light switches is used. In this case the jack body 37 has a rectangular protruding face 38 which is only slightly smaller than opening 32 so as to slide through the latter in a close fitting relationship. A standard jack socket 13 opens to rectangular protrusion 38. The jack body 37 is integral back 11 and with plate 12 which, in turn, is fastened by means of screws 29 to brackets (not shown) on a standard terminal box 46 of a type commonly used for electrical outlets. Box 46 is affixed to wall stud 27 by known means.

Before screwing down plate 12, wires 19 from a cable 34 are connected to terminal posts 42 (see FIG. 2) at the rear 11 of jack body 37. Once wall board has been installed, the cover plate 36 is placed over the protruding face 38 of jack body 37 and attached by screws through openings 26 which register with threaded holes 30. The latter step can easily be carried out by an untrained person rather than requiring a professional installer.

Figure 4:
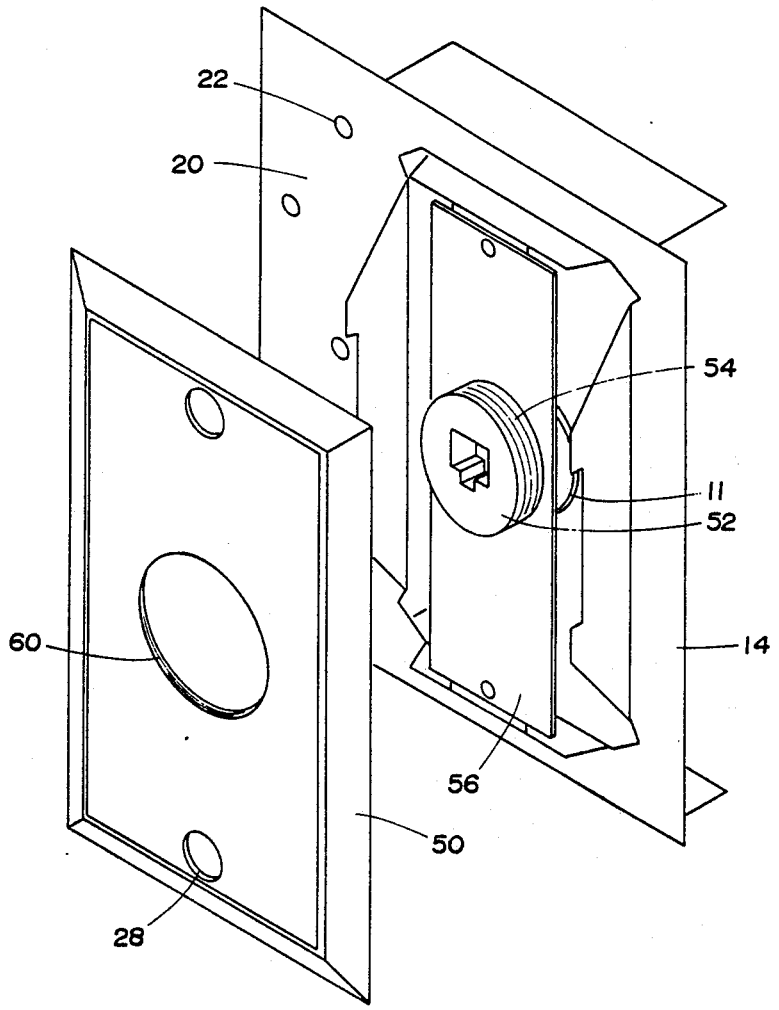
FIG. 4 is a perspective view of an embodiment showing the cover plate fastening to the jack body with ridges on the jack body engaging and capturing those on the cover plate opening.

In another embodiment shown in FIG. 4 a jack body 52 of cylindrical shape is mounted to plate 56 which has ridges 54 on its cylindrical surface. A cover plate 50 having an opening 60 also with ridges simply snaps over surface 54 and is held firmly in place by the cooperation of the ridges on the jack body 52 with those of the cover plate opening 60 without the need for cover plate mounting screws or other fasteners.

Figure 5:
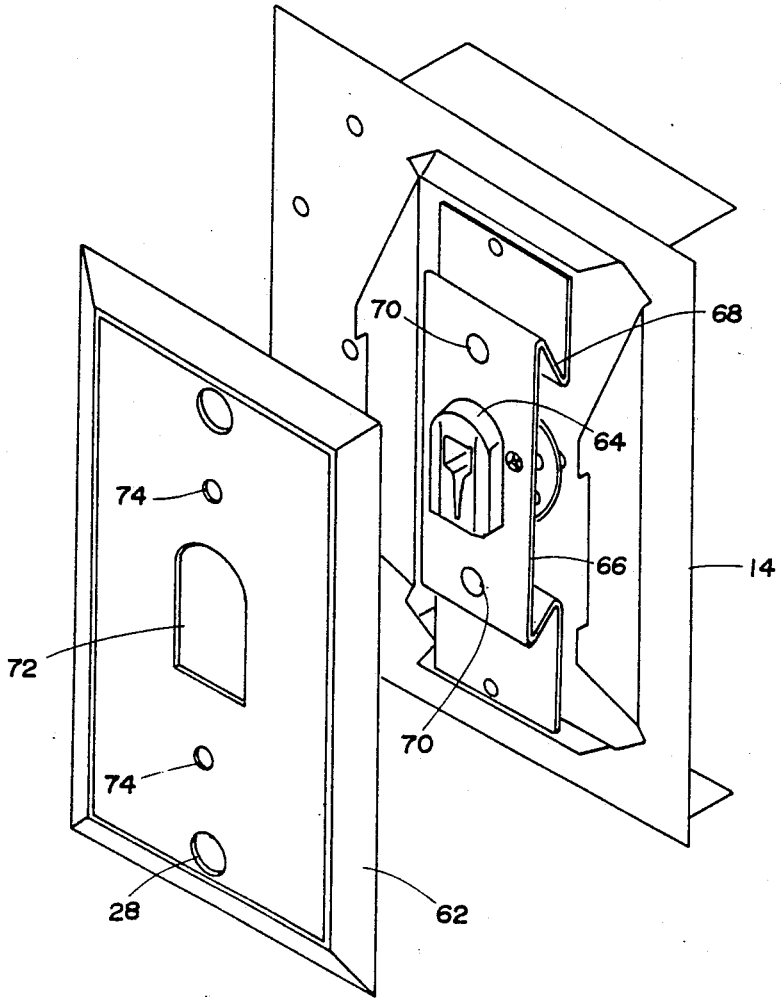
FIG. 5 is a perspective view of another embodiment showing a spring loaded mounting plate.

Finally FIG. 5 discloses an embodiment in which the mounting plate 66 is spring mounted by means of edges 68 bent back on themselves. Jack body 64 is thus spring loaded so as to project through opening 72 in cover plate 62 regardless of whether or not the surrounding wall board is level. In this case screws (not shown) passing through screw holes 74 and threadedly engaging threaded holes 70 hold the cover plate in place.

Although the mounting plate may be integral with the jack body 42 it may also be separate from the latter and be attached to the jack body either by means of screw fasteners or simply by ridges on the side of the front face of the jack body 42 or some other suitable type of snap fastener.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

I claim:

1. A telephone jack apparatus, comprising a jack body having a plug socket with a plurality of contacts therein, the socket opening to a front face of said body, electrical terminals on a rear face of said body each conductively connected to a corresponding one of said contacts in the plug socket and a mounting plate affixed to said body and attachable to a wall mounted support, a portion of the front face of said jack body enclosing the socket dimensioned to fit through an opening in a cover plate and means for attaching the cover plate to said mounting plate, wherein wires from a telephone cable are attachable to said rear face terminals prior to installation of wall board on said wall and wherein said mounting plate is dimensioned to be substantially narrower than said cover plate so that said plate does not interfere with the application of wall board and/or plaster up to a point underlying said cover plate and wherein said front face is dimensioned so as to fit through a standard electrical switch cover plate.

2. An apparatus according to claim 1, wherein said wall mounted support is a standard electrical box.

3. A wall jack apparatus, comprising:

a jack body having a front face and a rear face and a socket opening to both said front and rear faces;

a mounting plate affixed to said jack body and attachable to a wall support;

a plurality of terminal posts on the rear face of said jack body;

conductive means for electrically connecting each of a plurality of electrical connections in the socket opening to corresponding terminal posts;

fastening means for connecting wires from a communications cable to respective ones of said terminal posts;

wherein a portion of said front face is dimensioned to pass through an opening in a standard cover plate such that the socket opening may receive mating plug through said cover plate; and wherein sides of said jack body adapted to project through the cover plate opening have ridges and cooperate with associated ridges on sides of the cover plate opening to lock the cover plate to said jack body.

4. A wall jack apparatus, comprising:

a jack body having a front face and a rear face and a socket opening to both said front and rear faces;

a mounting plate affixed to said jack body and attachable to a wall support;

a plurality of terminal posts on the rear face of said jack body;

conductive means for electrically connecting each of a plurality of electrical connections in the socket opening to corresponding terminal posts;

fastening means for connecting wires from a communications cable to respective ones of said terminal posts;

wherein a portion of said front face is dimensioned to pass through an opening in a standard cover plate such that the socket opening may receive a mating plug through said cover plate; and wherein said mounting is bent on itself at either end thereof so as to be capable of movement normal to a plane through said plate against a restoring force provided by the plate itself.

* * * * *